United States Patent [19]

Moynihan

[11] Patent Number: 4,712,983

[45] Date of Patent: Dec. 15, 1987

[54] AIR COMPRESSOR ACCESSORY DRIVEN BY PORTABLE ELECTRIC DRILL

[76] Inventor: Patrick B. Moynihan, 1517 Charlestown Dr., Edgewood, Md. 21040

[21] Appl. No.: 796,178

[22] Filed: Nov. 8, 1985

[51] Int. Cl.[4] ..... F04B 35/00; F16H 37/08

[52] U.S. Cl. ..... 417/234; 417/411; 417/415; 74/665 C; 74/417

[58] Field of Search ..... 417/415, 234, 411, 15–17, 417/410; 74/670, 665 D, 665 Q, 49, 417, 665 C

[56] References Cited

U.S. PATENT DOCUMENTS

| | | | |
|---|---|---|---|
| 1,381,686 | 6/1921 | Whigelt | 74/670 X |
| 2,010,366 | 8/1935 | Kearns | 74/670 X |
| 2,244,683 | 6/1941 | Fisher | 74/665 Q X |
| 2,262,706 | 11/1941 | Benda | 74/417 |
| 2,348,266 | 5/1944 | Selby | 74/417 |
| 2,423,243 | 7/1947 | Lovely | 74/665 Q X |
| 2,517,910 | 8/1950 | Miller | 74/417 |
| 2,681,578 | 6/1954 | Shields | 74/665 Q |
| 2,694,953 | 4/1954 | Williams | 81/57 |
| 2,759,665 | 8/1956 | Wilber | 417/415 X |
| 2,907,242 | 6/1959 | Chakroff | 81/57 |
| 2,936,107 | 5/1960 | Blackburn | 417/16 X |
| 3,724,561 | 4/1973 | Merrels | 74/665 Q X |
| 4,566,370 | 5/1986 | Hanafi | 92/59 |
| 4,580,460 | 4/1986 | Chang et al. | 74/417 |

FOREIGN PATENT DOCUMENTS

| | | | |
|---|---|---|---|
| 446587 | 2/1948 | Canada | 417/415 |
| 851799 | 1/1940 | France | 417/415 |

OTHER PUBLICATIONS

*Power Air Pump,* General Hardware Mfg. Co., 1986.

*Primary Examiner*—Carlton R. Croyle
*Assistant Examiner*—Theodore Olds
*Attorney, Agent, or Firm*—Leonard Bloom

[57] ABSTRACT

A pneumatic pump has provision for being driven by a conventional electric hand drill and chuck that are unmodified so that they can be detached by loosening the chuck jaws and used for other purposes. The provision includes first and second input shafts protruding at right angles to each other and connected by a bevel gear on each. In addition to improving drive access, to provide a choice of drive ratios, the bevel gears have different diameters. The rotary output of the shaft and bevel gear arrangement drives a reciprocating piston in a cylinder that, in association with check valves and a hose connection, can inflate a pneumatic tire, at a speed and to a pressure, determined by which drive ratio is chosen. The drill can be freely swiveled about either input shaft to which attached. A gauge indicates cylinder pressure. A frame permits the assembly of drive and pump to be used to pressurize a tank for storage of compressed air.

12 Claims, 3 Drawing Figures

AIR COMPRESSOR ACCESSORY DRIVEN BY PORTABLE ELECTRIC DRILL

FIELD OF THE INVENTION

This invention relates generally to portable pneumatic tire inflation systems and particularly to a system that can be powered by an ordinary Jacobs type chuck-equipped pistol grip portable hand drill, either for use with line current or with a self-contained rechargeable battery pack.

SUMMARY OF THE INVENTION

In the prior art, portable inflation devices for pneumatic tires are known, some powered by house current, some by current from a vehicle on which used.

A pistol-grip tire inflater with integral electric motor driving reciprocating pump was disclosed in U.S. Pat. No. 4,080,105 issued to E. E. Connell on 3-21-78.

An attachment that converts rotary motion of an electric hand drill to reciprocating motion for a saw was disclosed in U.S. Pat. No. 3,876,015, issued to S. E. Kivela on 4-8-75.

However, it is believed that no invention known to date has provided the advantages of the present invention in accordance with the following objects and others that will become apparent from them.

A principal object is to provide a system that makes possible the inflation of a pneumatic vehicle-tire using an ordinary pistol-grip, chuck equipped, electric hand drill that is unmodified and can be used for other purposes.

Further objects are to provide a system as described that gives the user a choice of right-angle drive locations with different pumping ratios at the different locations for connecting hand drill to reciprocating pump.

Still a further object is to provide a system as described that has a gauge on the pump for indicating air pressure in the pump.

Yet further objects are to provide a system as described in which the drive permits the hand drill to swivel to any convenient angle about the axis, that is economical, convenient, durable and safe to use, and that can be mounted on a frame supplied and can have a ballast tank for evening-out demands for compressed air so that the system is useful for hobbycraft use, light painting and the like.

BRIEF DESCRIPTION OF THE DRAWINGS

The above and other objects and advantages of this invention will become more readily apparent on examination of the following description, including the drawings in which like reference numerals refer to like parts.

DETAILED DESCRIPTION

Figure 1:
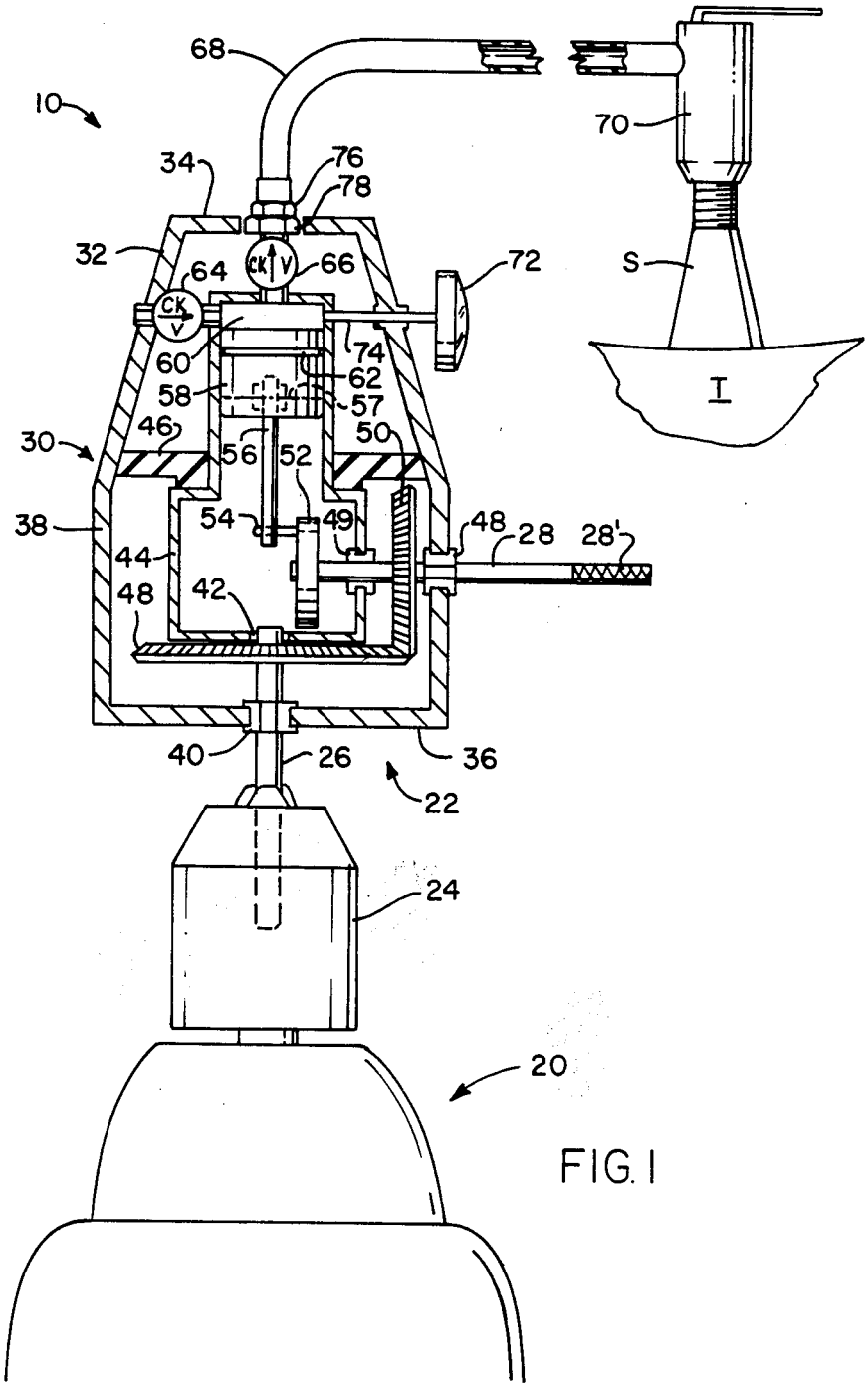
FIG. 1 is a partly sectional diagrammatic plan view of an embodiment of the invention in use inflating a tire; the scale is enlarged for clarity.

FIG. 1 shows embodiment 10 of the invention in use inflating a conventional pneumatic tire T.

Major elements of embodiment 10 are a pistol grip electric hand drill 20 (or other native power source) and a reciprocating pump 22 driven by the hand drill through detachable connection, as by a Jacobs type chuck 24 engaging one of two input shafts 26, 28 on the pump. The pump housing 30 is generally bullet-shaped or cylindrical and having a longitudinal axis and provided with a taper 32 converging toward the output end 34.

The first shaft, 26, protrudes axially from the pump housing 30 at the end 36 opposite the output end 34. The second shaft, 28, protrudes transversely of (and preferably at right angles to) the first shaft 26 from an intermediate portion of the cylindrical section 38 of the pump housing 30.

The first shaft 26 is mounted to the end 36 of the housing by a conventional bearing 40 that may be a ball bearing, a roller bearing, or a sleeve bearing, and the first shaft may have at the free end a further bearing 42 of any conventional type, mounting it to inner frame 44 which in turn may mount to the housing by an annular bracket 46 (that may be made of a suitable material) and constitutes a transverse web between the inner casing and the outer housing.

The housing 30 may be longitudinally split for insertion of the bearings, and for other assembly and maintenance.

The second shaft 28 mounts to the housing 30 by similar bearing arrangements at 48 and 49. The first and second shafts connect in rotation by a first bevel gear 48' fixed on the first shaft 26 and engaging a second bevel gear 50 fixed on the second shaft 28. For offering a choice of drive ratios, the second bevel gear 50 may be smaller in diameter, preferably half-diameter, relative to the first bevel gear 48'. For high pressure pumping the drive connection would be through the second shaft 28 and bevel gear 50. The shafts may have a knurled finish as at 28' for better grip when driven. Advantageously, it is unnecessary to consider direction of rotation of either shaft because of the type pump used. The first shaft 26 and the second shaft 28 are each rotatably supported between the housing and its inner casing.

On the inner end of the shaft 28 an eccentric pin mount 52 is fixed. Eccentric pin 54 (or other crank means) protrudes from it and conventionally drives connecting rod 56 and, through pivot 57, piston 58 in cylinder 60 of the reciprocating pump assembly 22. For simplicity, the piston 58 may have a grease groove 62 instead of a ring. The eccentric pin 54, connecting rod 56 and pivot 57 thus constitute a motion-converting means between the second shaft 28 and the piston 58 within the rearward portion of the casing. The first shaft 26 and piston 58 are aligned with the longitudinal axis of the cylindrical housing 30, as shown in FIG. 1.

First check valve 64 admits air intake to the cylinder 60 and second check valve 66 prevents back pressure from the pumped volume, here in the conventional pneumatic tire T to which flexible hose 68 connects by means of a conventional detachable connector 70 engaging the valve stem S. A pressure gauge 72 of any suitable type has a connection 74 for showing pressure in the cylinder 60.

A plastic or brass hose coupling 76 may hold the hose 68 at check valve 66 and maintain pressure connection with the output nipple 78.

Figure 2:
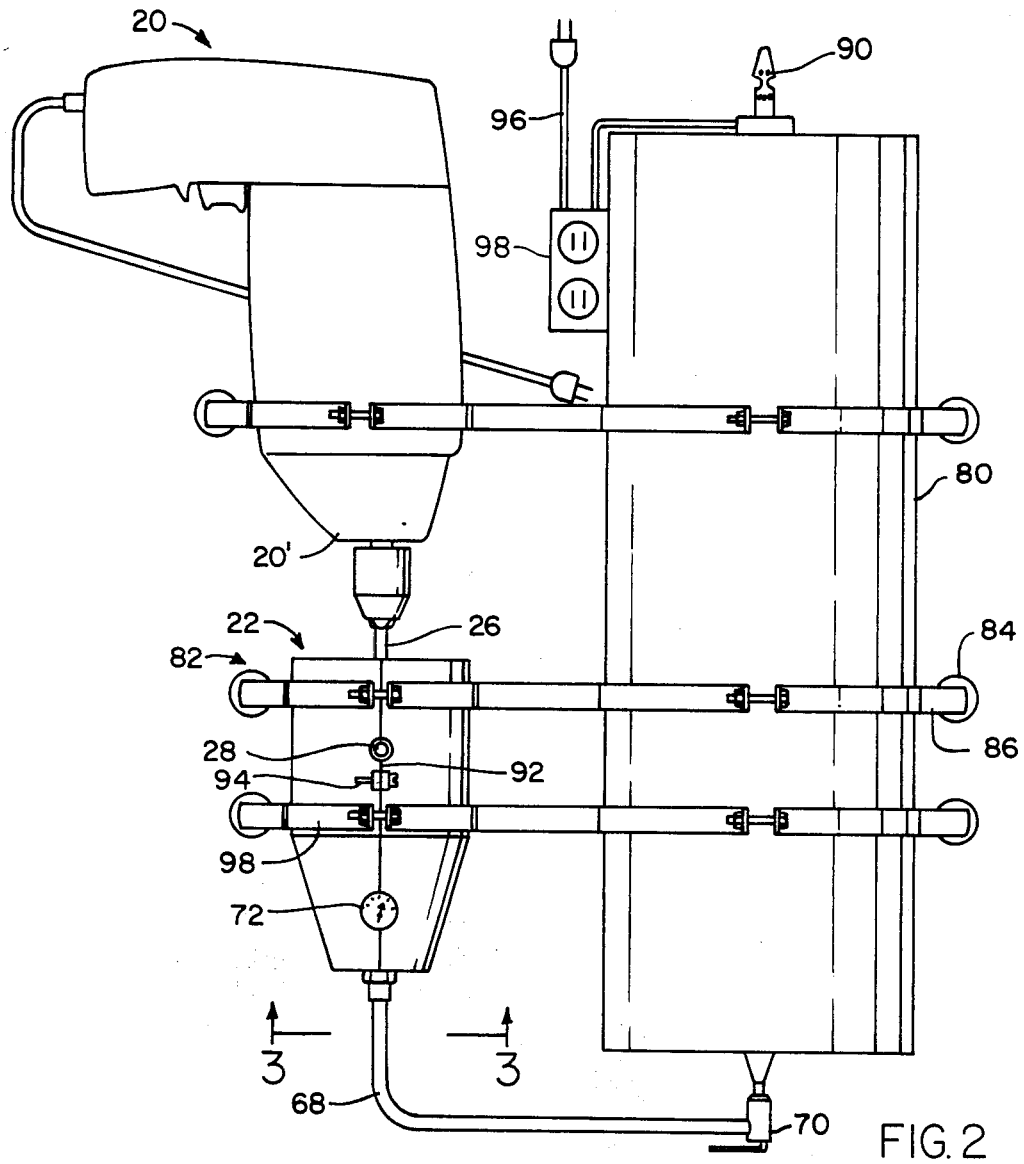
FIG. 2 is a plan view of a further embodiment that includes a frame mounted storage and distribution system for compressed air.

FIG. 2 shows on a small scale the mechanism described in reference to FIG. 1, further embodied in association with a pressure storage means or tank 80, on a supporting frame 82 with feet 84. Pressure gauge 72 indicates pump pressure.

The electric hand drill drive 20 may be freely swivelled by connection to either of the drive shafts 26, 28, but not to the frame, if desired, although the pump 22 and the body 20' of the drill may be secured to the frame 82 as indicated.

The frame may include cross members 86 terminating in the down-pointing feet 84 and connected to the cylindrical tank 80 by hose type clamps 98 looped over the frame, and when the pump and electric hand drill are secured to the frame, the entire unit may be manipulated conveniently by the pistol grip hand drill.

The hose 68 may be detachably secured at the free end to the tank inlet by an ordinary inflation fitting 70 and the tank may have an output hose fitting 90 at the opposite end.

The longitudinal split described in reference to FIG. 1 shows at 92. The halves may be conveniently joined by screws at 94. The hand drill may be driven from any convenient source, house current as at 96 or rechargeable battery carried by the drill, for example.

A conventional pressure-actuated switch 98 may be used to turn the outlet 100 on and off in accordance with pressure in tank 80, to control pumping.

Figure 3:
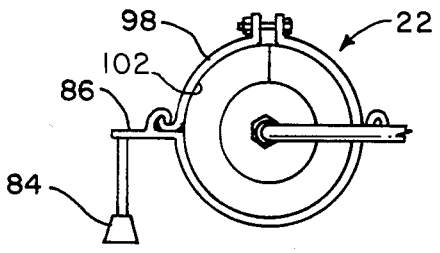
FIG. 3 is a view taken at 3—3, FIG. 2.

FIG. 3 shows the frame elements 86, 84 support the assembly as a unit; clamps 98 hold the elements represented by pump 22 into the arcuate contour, as at 102, of the frame. The tank is the principal structural member of the frame.

Material for the invention may be steel and/or any suitable thermoplastic. Rubber hose may be used.

The extreme handiness of this invention will be apparent in that anyone wanting a quick supply of compressed air needs only to lay his pistol-grip drill on a table by the compressor/ frame, connect the Jacobs chuck, and pull the trigger, all of which would take no more than ten to fifteen seconds.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by U.S. Letters Patent is:

1. An air compressor attachment adapted to be driven by a portable power drill, comprising a housing including a side wall and further including a rearward end wall, a casing within the housing, a transverse web supporting the casing within the housing, the casing including a forward portion extending forwardly of the transverse web and the casing further including a rearward portion extending rearwardly of the transverse web, the forward portion of the casing being formed as a cylinder having an axis and further having a cylindrical wall, such that the casing and the housing have a substantially continuous annular space therebetween, a first shaft rotatably supported between the rearward portion of the casing and the end wall of the housing, the first shaft being substantially coaxial with the axis of the cylinder, means for driving the first shaft by the portable power drill, a second shaft arranged substantially transversely of the first shaft, the second shaft being rotatably supported between the rearward portion of the casing and the side wall of the housing, the second shaft having a portion extending into the rearward portion of the casing, bevel gears carried by the first and second shafts, respectively, and providing an rpm step-up between the first and second shafts, the bevel gears being disposed between the casing and housing, respectively, crank means driven by the extending portion of the second shaft within the rearward portion of the casing, a piston guided for reciprocation within the cylinder, means for connecting the piston to the crank means, air inlet and exhaust means associated with the cylinder, and compressed air discharge means on the housing and communicating with the air exhaust means of the cylinder, and wherein the portable power drill may be held in one hand of the user, while the housing may be held in the other hand of the user, without regard to the heat generated by the reciprocation of the piston in the cylinder formed in the casing.

2. The attachment of claim 1, wherein the portable power drill comprises a portable electric drill.

3. The attachment of claim 1, wherein the housing is substantially cylindrical and includes a forward portion provided with a taper that converges forwardly of the housing.

4. An air compressor attachment adapted to be driven by a portable electric drill, comprising a housing including a rearward end wall and further including a cylindrical side wall, the housing further including a forward portion forwardly of the cylindrical side wall and provided with a taper that converges forwardly of the housing, a casing within the housing, a transverse web supporting the casing within the housing, the casing including a forward portion extending forwardly of the transverse web and the casing further including a rearward portion extending rearwardly of the transverse web, the forward portion of the casing being formed as a cylinder having an axis and further having a cylindrical wall, such that the casing and the housing have a substantially continuous annular space therebetween, a first shaft rotatably supported between the rearward portion of the casing and the end wall of the housing, the first shaft being substantially coaxial with the axis of the cylinder, means for driving the first shaft by the portable electric drill, a second shaft arranged substantially transversely of the first shaft, the second shaft being rotatably supported between the rearward portion of the casing and the side wall of the housing, the second shaft having a portion extending into the rearward portion of the casing, bevel gears carried by the first and second shafts, respectively, and providing an rpm step-up between the first and second shafts, the bevel gears being disposed between the casing and housing, respectively, crank means driven by the extending portion of the second shaft within the rearward portion of the casing, a piston guided for reciprocation within the cylinder, means for connecting the piston to the crank means, air inlet and exhaust means associated with the cylinder, and compressed air discharge means on the housing and communicating with the air exhaust means of the cylinder, and wherein the portable electric drill may be held in one hand of the user, while the housing may be held in the other hand of the user, without regard to the heat generated by the reciprocation of the piston in the cylinder formed in the casing.

5. An air compressor attachment adapted to be driven by a portable power drill, comprising a substantially cylindrical forwardly-tapered housing having a longitudinal axis and being adapted to be grasped by the hand, the housing including a side wall and a rearward end wall and further including a forward portion, a casing within the forward portion of the housing and provided with a cylinder, the cylinder having an axis aligned with the axis of the housing and further having a cylindrical wall, such that the casing and the housing have a substantially continuous annular space therebetween, a piston guided for reciprocation within the cylinder, a first shaft journaled in the end wall of the housing and adapted to be connected to the portable power drill, the first shaft and the piston being substantially aligned with each other along the longitudinal axis of the cylinder, a second shaft journaled in the side wall of the housing about an axis substantially perpendicular to the longitudinal axis of the first shaft, gearing means drivingly connecting the first shaft to the second shaft and providing a speed increase therebetween, motion converting means between the second shaft and the piston, air inlet and exhaust means associated with the cylinder, and compressed air discharge means on the housing and communicating with the air exhaust means of the cylinder, the compressed air discharge means being substantially aligned with the longitudinal axis of the housing, and wherein the portable power drill may be held in one hand of the user, while the housing may be held in the other hand of the user, without regard to the heat generated by the reciprocation of the piston in the cylinder formed in the casing.

6. The attachment of claim 5, wherein the casing includes a rearward portion having the motion converting means disposed therein.

7. The attachment of claim 6, wherein the first shaft is rotatably supported both in the rearward portion of the casing and in the rearward end wall of the housing, and wherein the second shaft is rotatably supported both in the rearward portion of the casing and in the side wall of the housing.

8. The attachment of claim 7, wherein the gearing means comprises a first bevel gear mounted on the first shaft and a second bevel gear mounted on the second shaft, the first and second gears being disposed between the casing and the housing.

9. The attachment of claim 8, wherein the portable power drill comprises a portable electric drill having a chuck for receiving the first shaft, and wherein the bevel gears provide substantially a 2:1 step-up in the rpm of the drill.

10. In an air compressor adapted to be driven by a portable power drill as an attachment thereto, the portable power drill having a chuck thereon, the combination of a housing having a longitudinal axis, a casing within the housing and having a longitudinal axis aligned with the axis of the housing, the casing including a cylinder formed therein, such that the housing and casing have an annular space therebetween, a piston guided for reciprocation in the cylinder along the longitudinal axis of the housing, a first shaft supported fore and aft thereof in a first set of spaced bearings in the housing and casing, respectively, the first shaft being substantially aligned with the longitudinal axes of the casing and housing, the first shaft being driven by the chuck of the portable power drill, a second shaft substantially at right angles to the first shaft, respectively, the second shaft being supported fore and aft thereof in a second set of spaced bearings in the housing and casing, respectively, first and second bevel gears carried by the first and second shafts, respectively, and providing a speed increase therebetween, motion-converting means between the second shaft and the piston, air inlet and exhaust means associated with the cylinder, and compressed air discharge means communicating with the air exhaust means, the compressed air discharge means being substantially aligned with the longitudinal axis of the housing, and wherein the portable power drill may be held in one hand of the user, while the housing may be held in the other hand of the user, without regard to the heat generated by the reciprocation of the piston in the cylinder formed in the casing.

11. In an air compressor adapted to be driven by a portable power drill as an attachment thereto, the portable power drill having a chuck thereon, the combination of a housing having a longitudinal axis, a casing within the housing and having a longitudinal axis aligned with the axis of the housing, such that the casing and housing have an annular space therebetween, the casing including a cylinder formed therein, a piston guided for reciprocation in the cylinder along the longitudinal axis of the housing, a first shaft journaled in the housing, the first shaft being substantially aligned with the longitudinal axes of the casing and the housing, respectively, the first shaft being driven by the chuck of the portable power drill, a second shaft in the housing substantially at right angles to the first shaft, first and second bevel gears carried by the first and second shafts, respectively, and providing a speed increase therebetween, motion-converting means between the second shaft and the piston, air inlet and exhaust means associated with the cylinder, the housing including a forward portion, and compressed air discharge means in the forward portion of the housing and communicating with the air exhaust means, the compressed air discharge means being substantially aligned with the longitudinal axis of the housing, and wherein the portable power drill may be held in one hand of the user, while the housing may be held in the other hand of the user, without regard to the heat generated by the reciprocation of the piston in the cylinder formed in the casing.

12. In an air compressor adapted to be driven by a portable power drill as an attachment thereto, the combination of a housing having a longitudinal axis and including a cylinder formed therein, a piston guided for reciprocation in the cylinder along the longitudinal axis of the housing, a first shaft journaled in the housing and driven by the drill, the first shaft being substantially aligned with the longitudinal axis of the housing, a second shaft in the housing substantially at right angles to the first shaft, first and second bevel gears carried by the first and second shafts, respectively, motion-converting means between the second shaft and the piston, air inlet and exhaust means associated with the cylinder, the housing including a forward portion, and compressed air discharge means in the forward portion of the housing and communicating with the air exhaust means, the compressed air discharge means being substantially aligned with the longitudinal axis of the housing, further including means for selectively driving either the first shaft or the second shaft by the portable power drill, and wherein when the first shaft is driven by the portable power drill the first and second shafts provide substantially a 2:1 speed increase therebetween, such that the air compressor may be operated at a speed substantially tailored to the rpm output of the drill.

* * * * *